US006292643B1

(12) United States Patent
Vo

(10) Patent No.: US 6,292,643 B1
(45) Date of Patent: Sep. 18, 2001

(54) PRINTING SYSTEM FOR APPLYING A MIXED COMBINATION OF COLORANTS FOR ONE SEPARATION TO A PHOTORECEPTOR

(75) Inventor: Tuan Anh Vo, Hawthorne, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/613,018

(22) Filed: Jul. 10, 2000

(51) Int. Cl.[7] ..... G03G 15/08

(52) U.S. Cl. ..... 399/252; 399/266; 399/285; 399/291

(58) Field of Search ..... 399/252, 265, 399/266, 272, 281, 290, 291, 254, 285, 289

(56) References Cited

U.S. PATENT DOCUMENTS 5,893,015 * 8/1999 Mojarradi et al. ..... 399/291

6,175,707 * 1/2001 Eklund et al. ..... 399/265

* cited by examiner

*Primary Examiner*—Sandra Brase
*Assistant Examiner*—Hoan Tran
(74) *Attorney, Agent, or Firm*—Philip T. Virga

(57) ABSTRACT

In a xerographic printer, the use of traveling wave toner transport devices to deliver toner from the individual single color toner sumps to an intermediate traveling wave belt by utilizing traveling wave roll-type devices, and the traveling wave belt to carry the combination of toners to the photoreceptor. The toner could be composed of two or more toner color particles which are used as a custom color. The traveling wave transport belt mixes the two or more colors while transporting them, so that pre-mixing a custom color, and delivering it separately to the photoreceptor, is not necessary, thus enabling the use of an ordinary CMYK color printer to be used to print custom colors.

5 Claims, 4 Drawing Sheets

PRINTING SYSTEM FOR APPLYING A MIXED COMBINATION OF COLORANTS FOR ONE SEPARATION TO A PHOTORECEPTOR

BACKGROUND OF THE INVENTION

Apparatus for mixing custom color toner for a color copier or printer using a traveling wave toner transport device, hereinafter referred to as a "device", which mixes the colorants while transporting them to the photoreceptor.

In a typical color copier or printer, three color separations, cyan, magenta and yellow (CMY), can be used to create all colors in a final color print. However, while black can be generated by the use of these three colors, a better print will result if black toner is also used (CMYK) to produce the darker tones, resulting in four separations.

A further refinement is to use a custom color for special areas. For example, skin tones are difficult to reproduce in standard CMYK systems because, in any combination of toners, the separate colors are applied one on top of the other, and so a smooth blend of toner is difficult to produce. If a custom color is required it is typical to load pre-mixed toner into the printer and use it as an additional separation. However, this can be inconvenient since the custom color toner must be loaded into the printer before printing and removed after the run is complete.

What is needed is a system that can mix a custom color from the original CMYK toners and apply that to the photoreceptor.

SUMMARY OF THE INVENTION

This invention uses traveling wave toner transport devices to transport and mix toner. In its simplest form, a device is a belt made from insulating material on which is formed a lattice of conducting lines. Most of the lines are grounded but at regular intervals there are some that are held at a voltage. Further, each voltage is switched over time to adjacent lines, so that the overall effect is a voltage field that travels down the belt. Since the toner particles are themselves charged, they will be transported down the stationary belt as the voltage wave carries them. Such a device is described in U.S. Pat. No. 5,717,986 which is incorporated by reference herein.

A number of devices, one for each toner, are generally cylindrical in shape, round, oval or the like, and transport toner from each toner supply to an intermediate device in the form of a belt. The belt device carrying all of the colorants then transports the toner to the photoreceptor. A property of the traveling wave transportation process is that the various toners deposited on it are mixed as they are being transported. Thus, although the colorants are applied separately to the belt, they are fully mixed when they arrive at the photoreceptor, and so can be used as a custom color at that point. The result is that custom colors need not be pre-mixed and separately loaded into the printer for the additional separation.

DETAILED DESCRIPTION OF THE INVENTION

Figure 1:
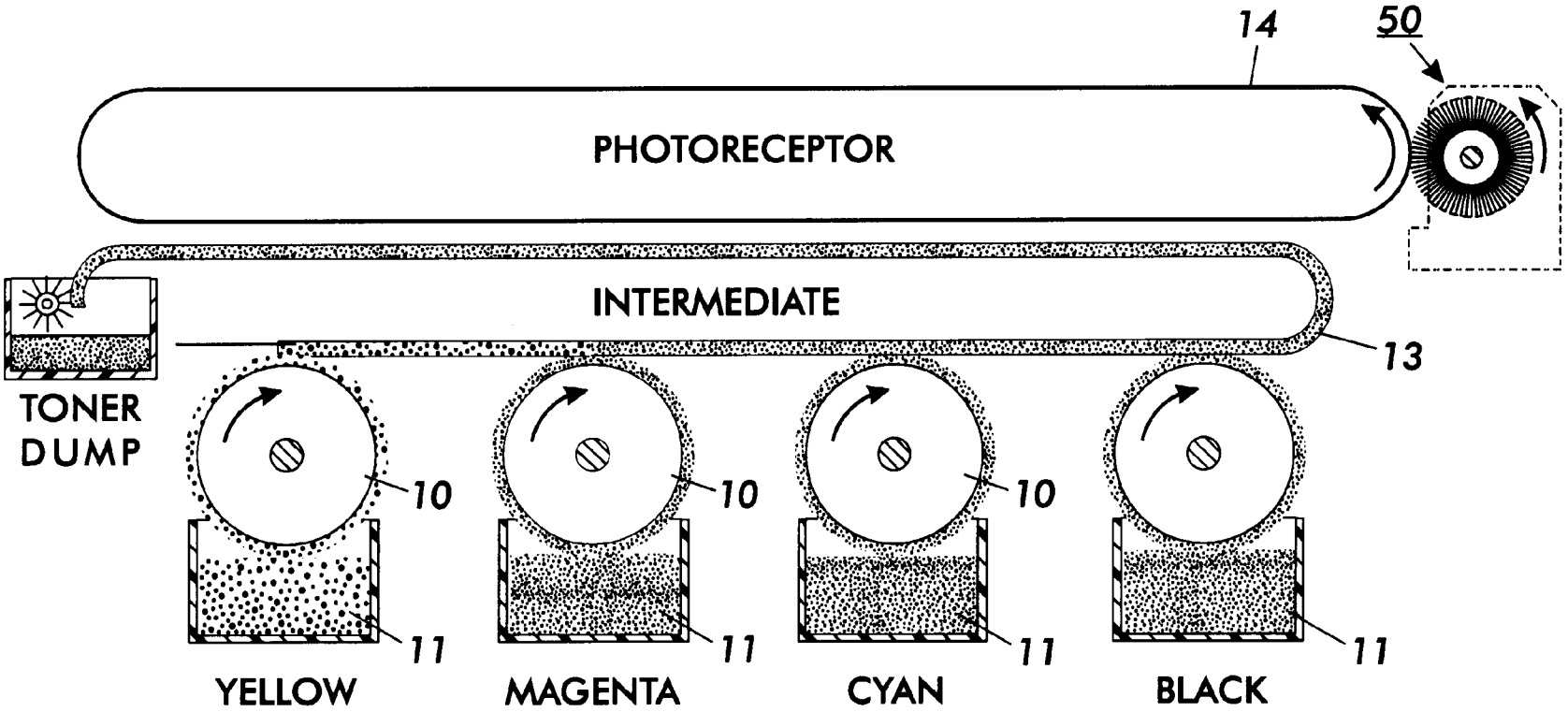
FIG. 1 is an overall diagram of the system.

The system shown in FIG. 1 overcomes the difficulties of the prior systems. There are four single color travelling wave devices 10 for the four primary colors. Each color toner will be loaded onto its device by the traveling wave on the grid from a toner source of any kind such as a sump 11. The toner will travel around the device 10 and return the excess back to the sump 11.

At the top of the device 10, the dry toner cloud will be partially taken up by the intermediate traveling wave device belt 13 and carried in the direction of the arrow. Since the toner is carried in the form of a cloud of particles that are in constant motion, the several toners will be thoroughly mixed by the time they are deposited onto intermediate device belt 13. Finally, the belt will deliver the cloud to the photoreceptor 14 which has been exposed to the image of the current separation, resulting in the partial depositing of the toner onto the photoreceptor 14.

Figure 5:
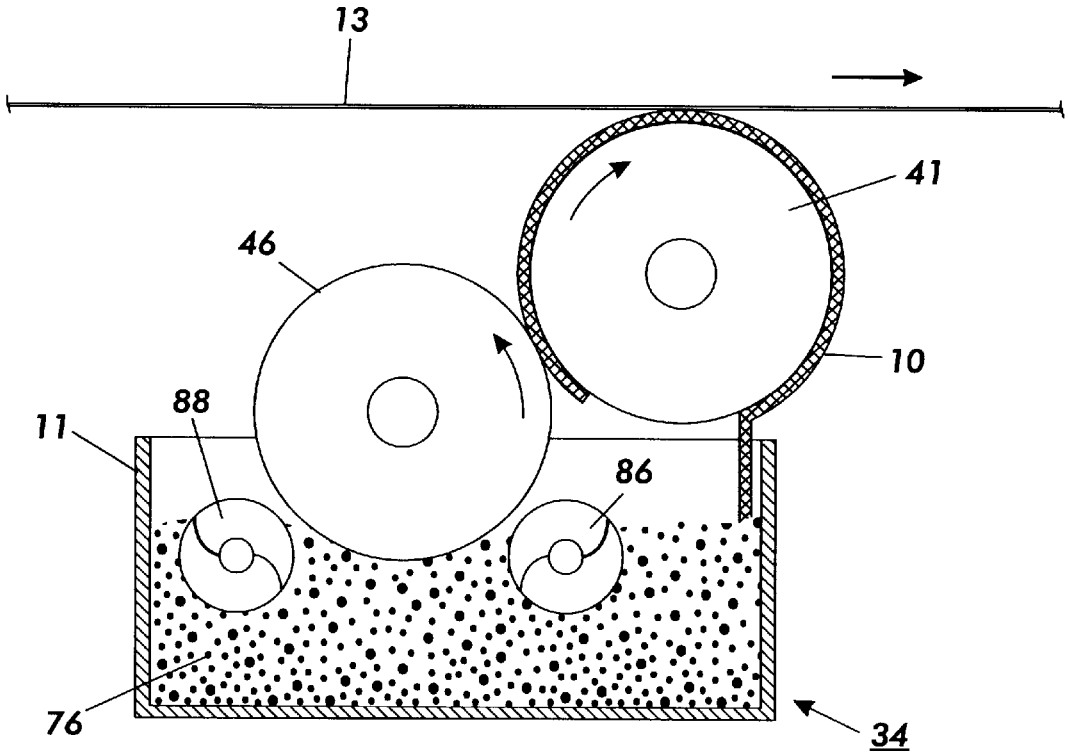
FIG. 5 is a more detailed view of the development system.

The development system 34 comprising the sump 11 and device 10 of FIG. 1, shown in more detail in FIG. 5, includes a chamber 76 for storing a supply of developer material which is mixed by two augers 86, 88. Device 10 is mounted on a stationary fixture 41, and together with the magnetic roller 46, are located above the chamber 76. A magnetic roller 46 can be rotated in either the "with" or "against" direction relative to the direction of motion of the toner on the device 10 and is used to deposit toner onto the device 10. Similarly, toner on device 10 can be traveling in either the "with" or "against" direction relative to the direction of toner on the intermediate traveling wave device belt 13.

Figure 2:
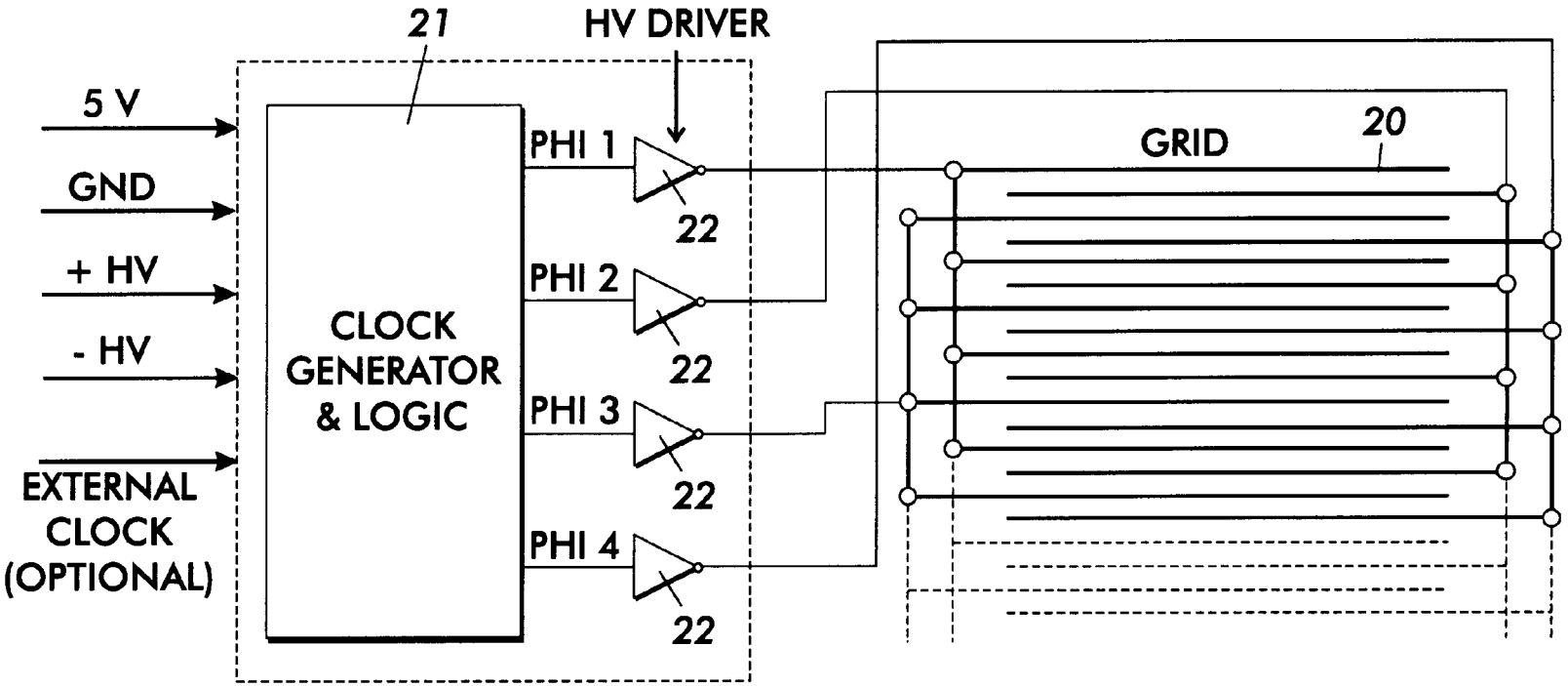
FIG. 2 shows the details of the device.

The single color devices 10 and the intermediate device 13 comprise a flexible circuit board having a finely spaced electrode array thereon as shown in FIG. 2. The grid is composed of several sets of electrodes 20 deposited on a flexible substrate, and applied voltages with the appropriate amplitude and phase such as to move the toner cloud forward above the surface of the grid are applied. This flexible substrate and grid can be formed into any shape, either flat for the belt or circular or oval for a roll. The grid used in this embodiment has 100 micrometer wide electrodes, separated by 100 micrometers. Toner can be moved on this grid with or without an electrically relaxable polymer overcoat layer.

The amount of toner loaded is determined by the pulse width and amplitude, and the transport speed can be controlled by the frequency of the electrical signals applied to the traveling wave grid, resulting in speeds of approximately one meter per second.

Figure 3:
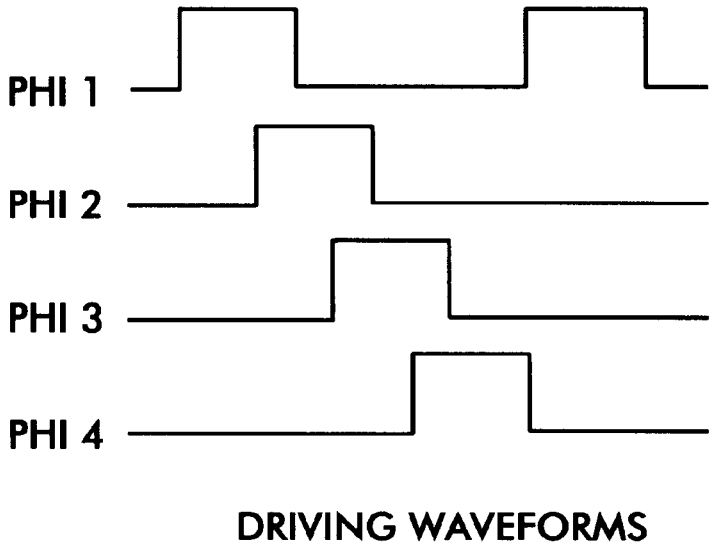
FIG. 3 is a table of waveshapes.
Figure 4:
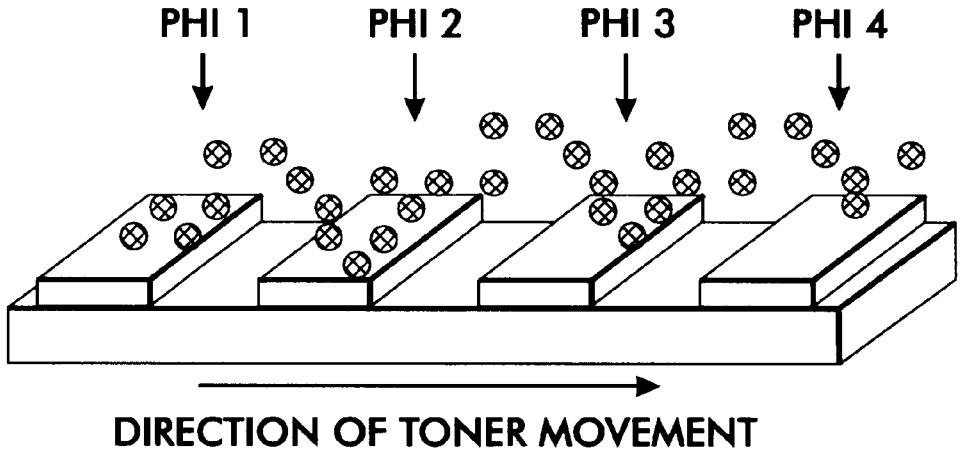
FIG. 4 shows a wave of colorant.

Four phases of driving signal, Phi 1–4, are generated in the clock generator and logic section 21, which has inputs of an optional clock, five volts, ground, and plus and minus high voltage. These phases, shown in FIG. 3, are applied to the grid of FIG. 2, to result in the toner movement shown in FIG. 4. Typical voltages are zero and four hundred volts, and there is some overlap of the phase waveshapes, as shown.

The single colorant devices 10 and the intermediate device 13 transport the toner by the same process to a development zone where the toner is attracted to the photoreceptor 14. After development the residual toner on the intermediate device 13 is moved to a toner dump container. Complete removal of residual toner from the photoreceptor is accomplished by a combination of electrical forces from the grid and mechanical forces from a cleaning brush for removing a remaining toner on the intermediate travelling wave device.

Combining toner transport and mixing in the intermediate device in the manner described has many other advantages. Color mixing is in-situ by electronic controls that regulate precisely the amount of toners or colorants there are on the grids, to eliminate expensive pre-mixed custom color toner and therefore offers versatility in the color process. In this embodiment grid voltages are either fully ON or OFF, and the amount of toner is determined by pulse width modulation. Jumping development enables superior image quality to in-contact magnetic brush development systems and allows an improved throughput in a one-pass color system. The conveyor grids are fabricated on flexible substrates, allowing them to be mounted on holding fixtures of any shape, which enables long and stable development zones, important for high efficiency development at high process speeds.

Also, the use of electrical forces to move toner minimizes the number of moving parts in the development system and eliminates some mechanical disturbances in the development nip due to run-out, for example. Similarly, the development system width can be increased without added mechanical instability. Finally, since sections of the conveyer can be separated electrically, different electrical signals can be applied to grid areas in each of the different zones (loading, development and unloading) to optimize each of the steps in the toner cycle.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. A printing system for applying a mixed combination of colorants for one separation to a photoreceptor comprising:

an intermediate travelling wave device for receiving colorants, for mixing the colorants, and for transporting the colorants to the photoreceptor, a first sump containing a first colorant and a second sump containing a second colorant, and a single colorant travelling wave device for each sump for taking colorant from the sump and delivering it to the intermediate travelling wave device.

2. The printing system of claim 1 wherein the single colorant travelling wave device for each sump picks up colorant from the sump, transfers some to the intermediate travelling wave device and returns a remainder to the sump.

3. The printing system of claim 1 wherein the intermediate travelling wave device picks up colorant from the two single colorant travelling wave devices, transfers some of the mixed colorants to the photoreceptor and returns a remainder to a toner dump.

4. The printing system of claim 3 wherein a brush is used to remove the remainder of the mixed colorants from the intermediate travelling wave device.

5. The printing system of claim 1 wherein the intermediate and single color travelling wave devices comprise electrical conductors attached to a flexible insulative substrate.

* * * * *